US011441752B2

(12) United States Patent
Lim et al.

(10) Patent No.: US 11,441,752 B2
(45) Date of Patent: Sep. 13, 2022

(54) LIGHT DEVICE FOR GENERATING PLURALITY OF BEAM PATTERN IMAGES

(71) Applicants: HYUNDAI MOTOR COMPANY, Seoul (KR); KIA MOTORS CORPORATION, Seoul (KR)

(72) Inventors: Jung Wook Lim, Seoul (KR); Byoung Suk Ahn, Gwacheon-si (KR); Seung Sik Han, Hwaseong-si (KR); Sung Ho Park, Seoul (KR); Ki Hong Lee, Seoul (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 16/923,470

(22) Filed: Jul. 8, 2020

(65) Prior Publication Data

US 2021/0262634 A1 Aug. 26, 2021

(30) Foreign Application Priority Data

Feb. 25, 2020 (KR) ..... 10-2020-0023155

(51) Int. Cl.

| | |
|---|---|
| ***F21S 41/663*** | (2018.01) |
| ***F21S 41/657*** | (2018.01) |
| ***F21S 41/14*** | (2018.01) |
| ***F21S 41/25*** | (2018.01) |

(52) U.S. Cl.

CPC ..... *F21S 41/663* (2018.01); *F21S 41/18* (2018.01); *F21S 41/25* (2018.01); *F21S 41/657* (2018.01)

(58) Field of Classification Search

CPC ..... F21S 41/141; F21S 41/143; F21S 41/151; F21S 41/153; F21S 41/40; F21S 41/43; F21S 41/663

See application file for complete search history.

(56) References Cited

U.S. PATENT DOCUMENTS

| | | | | |
|---|---|---|---|---|
| 10,232,763 | B1 * | 3/2019 | Eckstein | F21S 41/285 |
| 10,246,002 | B2 * | 4/2019 | Mouri | F21S 41/285 |
| 10,746,370 | B2 * | 8/2020 | Han | F21S 41/143 |
| 2019/0072252 | A1 * | 3/2019 | Moser | F21S 41/68 |

FOREIGN PATENT DOCUMENTS

| | | | | |
|---|---|---|---|---|
| EP | 3636992 | A1 * | 4/2020 | F21S 43/50 |
| JP | 2015-115276 | A | 6/2015 | |

* cited by examiner

*Primary Examiner* — Matthew J. Peerce

(74) *Attorney, Agent, or Firm* — Morgan, Lewis & Bockius LLP

(57) ABSTRACT

A light device is configured to generate a plurality of beam pattern images in which various images of light emitted from a plurality of fine light emitters are projected through fine lenses and shields, whereby various images of light are projected in accordance with whether the fine light emitters are turned on. Further, a light source array, a shield array, and a lens array are each formed in a plate shape, so the size decreases and the structure is simplified.

8 Claims, 11 Drawing Sheets

LIGHT DEVICE FOR GENERATING PLURALITY OF BEAM PATTERN IMAGES

CROSS REFERENCE TO RELATED APPLICATION

The present application claims priority to Korean Patent Application No. 10-2020-0023155, filed Feb. 25, 2020, the entire contents of which are incorporated herein for all purposes by this reference.

TECHNICAL FIELD

The present disclosure relates to a light device configured to generate a plurality of beam pattern images, the light device capable to generate various lighting patterns and having a simple optical structure.

BACKGROUND

In general, vehicles are equipped with lighting systems for more clearly showing objects in the front area of the vehicles in nighttime driving and for showing the driving states of the vehicles to other vehicles or people in the streets. For example, the lamp, which is called a headlight, is a light that lights the road that is ahead in the driving direction of a vehicle.

Automotive lamps are classified into a headlamp, a daytime running lamp, a fog lamp, a turn signal, a brake light, a reversing light, etc., and are set to radiate light in different directions on the surfaces of roads.

Recently, as autonomous vehicles are developed, lamps radiate light to the road and messages are transmitted through the lamps.

However, only fixed images are turned on when images are radiated through lamps in the related art, so there is a limitation in transmission of messages, and the volume including a lens structure is excessively increased to secure optical efficiency in radiation of images.

The description provided above as a related art of the present disclosure is just for helping understanding the background of the present disclosure and should not be construed as being included in the related art known by those skilled in the art.

SUMMARY

The present disclosure has been made in an effort to solve the problems and an aspect of the present disclosure is to provide a light device configured to generate a plurality of beam pattern images, the light device having a simple structure and capable to generate various lighting patterns.

In accordance with an aspect of the present disclosure, a light device includes: a light source array including a substrate and a plurality of fine light emitters arranged on the substrate and configured to be individually turned on; and a shield array disposed ahead of the light source array, including shields respectively matched to the fine light emitters. Each of the shields has a hole through which light passes, and some or all of the holes have different shapes so that a light pattern corresponding to the shapes of the holes is projected when some or all of the fine light emitters are turned on.

The light device further includes a lens array disposed ahead of the light source array and including a plurality of fine lenses respectively matched to the fine light emitters.

The lens array includes: a first lens array disposed between the light source array and the shield array and configured to change the light emitted from the fine light emitters into parallel light; and a second lens array disposed between the first lens array and the shield array and configured to converge the light that has passed through the first lens array.

The first lens array is matched to the light source array and has a plurality of first fine lenses respectively matched to the plurality of fine light emitters, and the plurality of first fine lenses change the light emitted from the plurality of fine light emitters into parallel light.

The second lens array is matched to the first lens array and has a plurality of second fine lenses respectively matched to the first fine lenses, and the plurality of second fine lenses converge the parallel light traveling through the plurality of first fine lenses to the shields.

The lens array further includes a third lens array disposed opposite the second lens array with the shield array therebetween and sending light, which has passed through the shield array, to the outside.

The third lens array is matched to the shield array and has a plurality of third fine lenses respectively matched to the shields, and the plurality of third fine lenses project light traveling from inside through the shields to the outside.

Some or all of the holes of the shield array have symbol shapes including different characters and numbers.

Some or all of the holes of the shield array have a rectangular edge, a horizontal portion horizontally crossing the center of the rectangle, a vertical portion vertically crossing the center of the rectangle, and a pair of diagonal portions diagonally crossing the center of the rectangle in different directions, in which the edge, the horizontal portion, the vertical portion, and the diagonal portions are each cut half to have the same pattern with two lines and any one line of each of the lines are open.

The light source array and the shield array are disposed in a housing, thereby forming one assembly, and the housing is configured to be rotated by power from a driving unit.

The housing has a rotary shaft vertically extending and the driving unit is connected to the rotary shaft and configured to rotate the rotary shaft, whereby a pattern shape of light is projected in a rotational range of the housing in accordance with rotation of the housing.

The light device is configured to generate a plurality of beam pattern images.

According to the light device configured to generate a plurality of beam pattern images that has the structure described above, various images of light emitted from a plurality of fine light emitters are projected through fine lenses and shields, whereby various images of light are projected in accordance with whether the fine light emitters are turned on. Further, the light source array, the shield array, and the lens array are each formed in a plate shape, so the size decreases and the structure is simplified.

BRIEF DESCRIPTION OF THE DRAWINGS

The above and other aspects, features and advantages of the present disclosure will be more apparent from the following detailed description taken in conjunction with the accompanying drawings, in which.

DETAILED DESCRIPTION OF THE EXEMPLARY EMBODIMENTS

A light device configured to generate a plurality of beam pattern images according to exemplary embodiments of the present disclosure is described hereafter with reference to the accompanying drawings.

Figure 1:
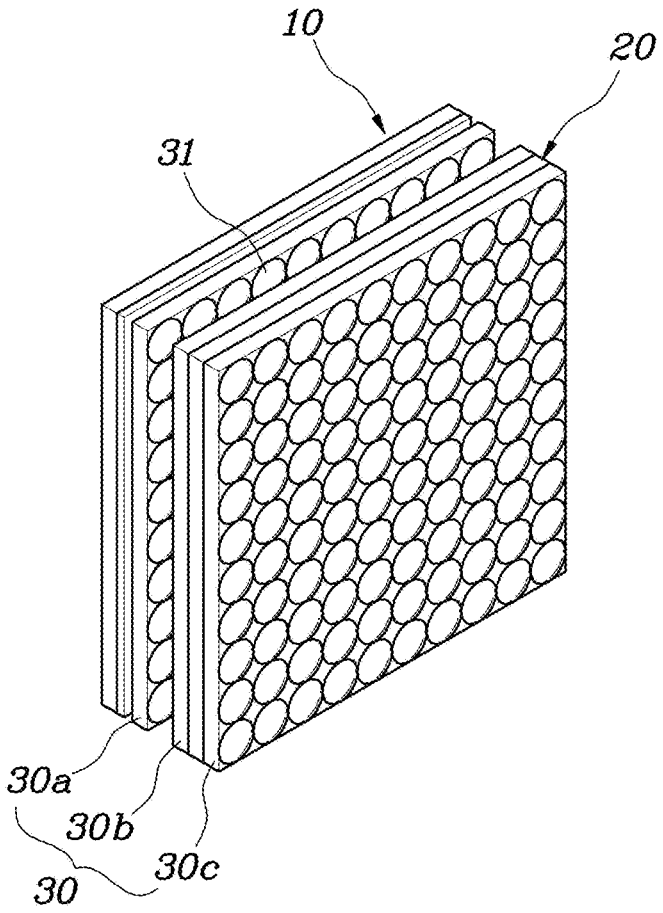
FIG. 1 is a view showing a light device configured to generate a plurality of beam pattern images according to an embodiment of the present disclosure.
Figure 2:
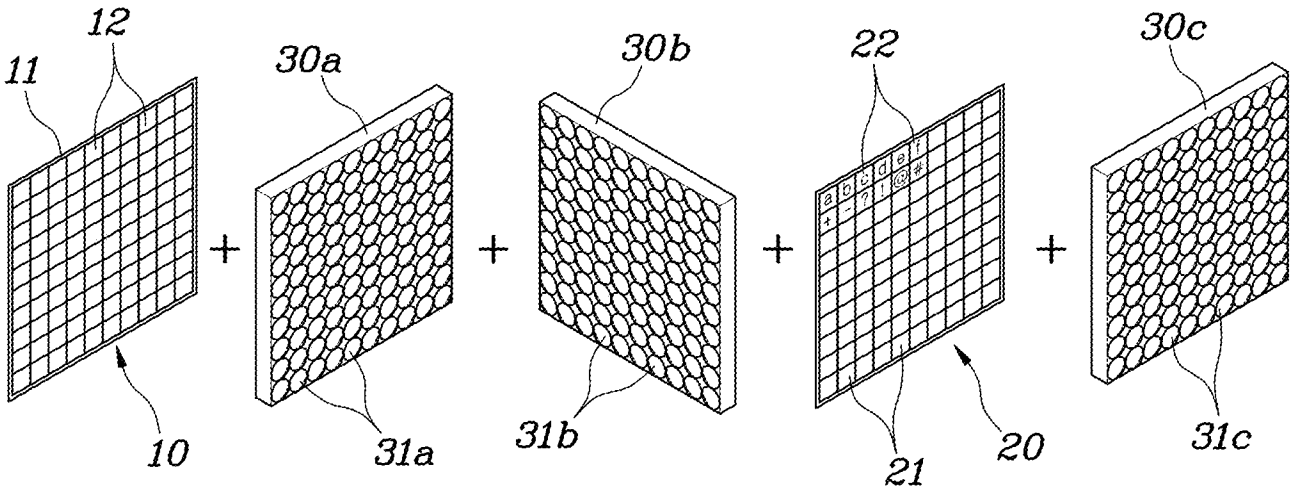
FIG. 2 is an assembly view of the light device configured to generate a plurality of beam pattern images shown in FIG. 1.
Figure 3:
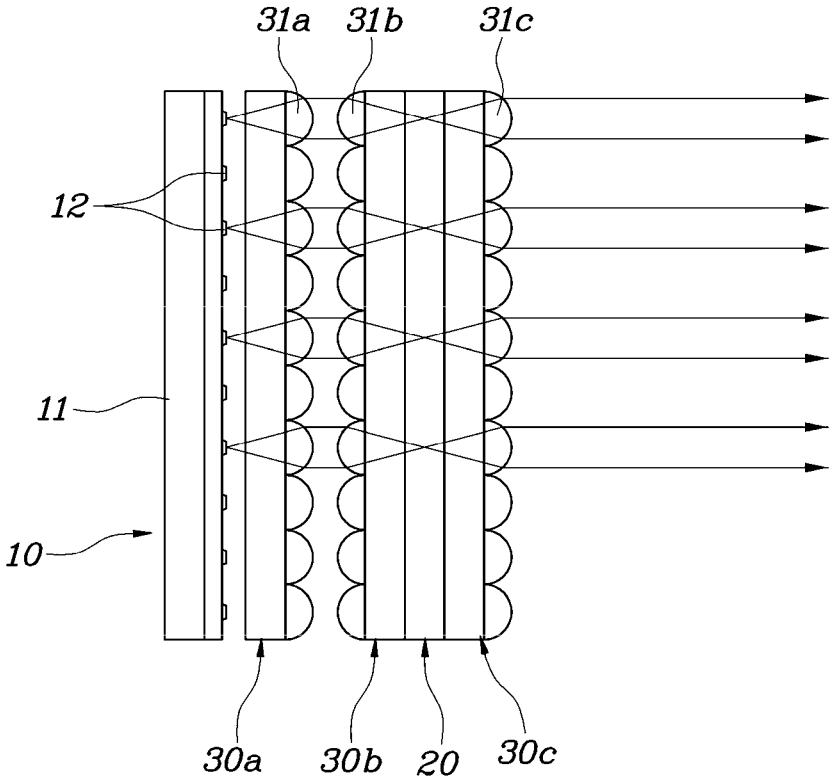
FIGS. 3 to 4 are views showing the light device configured to generate a plurality of beam pattern images shown in FIG. 1.
Figure 4:
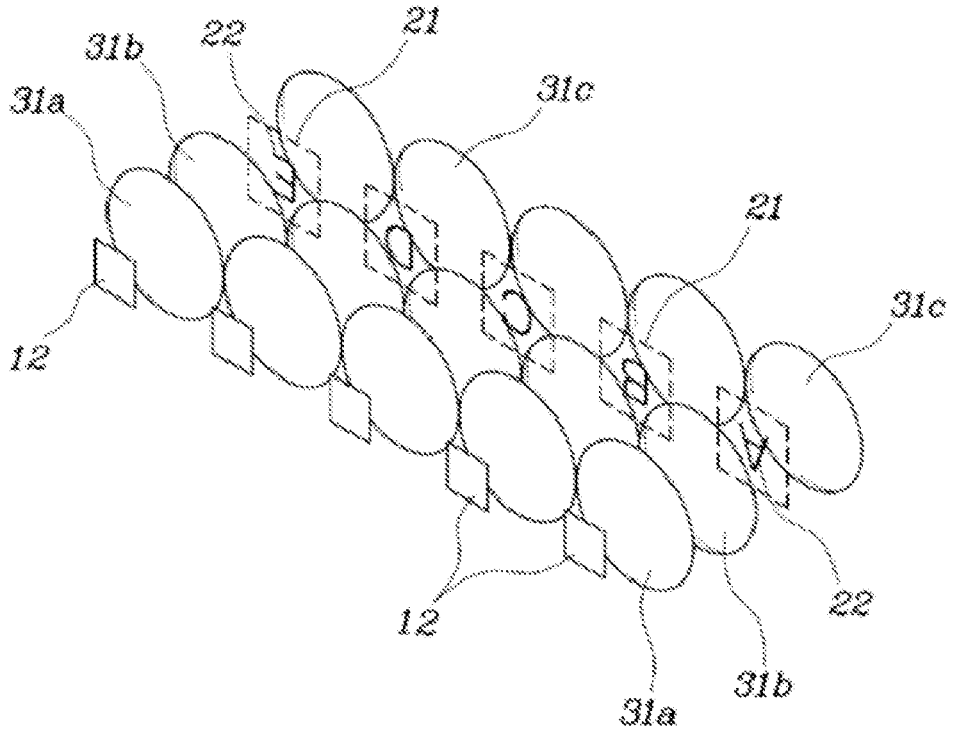

FIG. 1 is a view showing a light device configured to generate a plurality of beam pattern images according to an embodiment of the present disclosure, FIG. 2 is an assembly view of the light device configured to generate a plurality of beam pattern images shown in FIG. 1, FIGS. 3 to 4 are views showing the light device configured to generate a plurality of beam pattern images shown in FIG. 1, and FIGS. 5 to 11 are views showing embodiments of the light device configured to generate a plurality of beam pattern images shown in FIG. 1.

A light device configured to generate a plurality of beam pattern images according to the present disclosure, as shown in FIGS. 1 to 3, includes: a light source array 10 including a substrate 11 and a plurality of fine light emitters 12 arranged on the substrate 11 and being configured to be individually turned on; and a shield array 20 disposed ahead of the light source array 10, including shields 21 respectively matched to the fine light emitters 12, in which each of the shields 21 has a hole 22 that passes light, some or all of the holes 22 have different shapes so that a light pattern corresponding to the shapes of the holes 22 is projected when some or all of the fine light emitters 12 are turned on.

As described above, the light device of the present disclosure includes the light source array 10 and the shield array 20, whereby light emitted from the light source array 10 is projected as light with a specific image when the light passes through the shield array 20.

The light source array 10 have a plurality of fine light emitters 12 mounted on the substrate 11 and may be composed of micro LEDs. The fine light emitters 12 are individually turned on on the substrate 11, so the light source array 10 can have various emission shapes.

The shield array 20 is disposed ahead of the light source array 10 and receives the light emitted from the fine light emitters 12. In particular, the shield array 20 has a plurality of shields 21 respectively corresponding to the fine light emitters 12 and the shields 21 each have a hole 22 through which the light passes. Accordingly, when the light emitted from the fine light emitters 12 passes through the shields 21, the image of the light that is projected to the outside is determined by the shapes of the holes 22 which the light passes through.

Since the holes 22 of the shields 21 have different shapes, the image shape of the light that is projected to the outside through the holes 22 can be varied in accordance with whether some of the fine light emitters 12 are turned on.

That is, the fine light emitters 12 and the shields 21 are matched respectively to each other and the holes 22 of the shields 21 have different shapes, so a beam pattern image according to the shapes of the holes 22 of specific shields 21 is projected, depending on whether specific fine light emitters 12 of the fine light emitters 12 are turned on. Thus, it is possible to achieve various beam patterns in accordance with the shapes of the holes 22 of the shields 21.

The light device may further include a lens array 30 disposed ahead of the light source array 10 and including a plurality of fine lenses 31 respectively matched to the fine light emitters 12. The lens array 30 converges the light emitted from the fine light emitters 12 to the shields 21. Accordingly, a plurality of fine lens 31 respectively matched to the fine light emitters 12 and the shields 21 are disposed in the lens array 30.

In detail, as shown in FIGS. 1 to 4, the lens array 30 may be composed of a first lens array 30*a* disposed between the light source array 10 and the shield array 20 and changes the light emitted from the fine light emitters 12 into parallel light, and a second lens array 30*b* disposed between the first lens array 30*a* and the shield array 20 and converging the light that has passed through the first lens array 30*a*.

The lens array 30, as described above, may be composed of the separate first lens array 30*a* and second lens array 30*b*. The first lens array 30*a* changes the light emitted from the fine light emitters 12 into parallel light, such that the parallel light travels to the shields 21 of the shield array 20 and the second lens array 30*b* converges the parallel light produced through the first lens array 30*a* to the shields 21. Accordingly, the light emitted from the fine light emitters 12 of the light source array 10 is changed into parallel light by the first lens array 30*a* and is converged to the shields 21 through the second lens array 30*b*, so a loss of light is minimized, and thus, light efficiency can be increased and the image made by the light that has passed through the shields 21 can be clearly projected.

In detail, the first lens array 30*a* is matched to the light source array 10 and has a plurality of first fine lenses 31*a* respectively matched to the fine light emitters 12, and the first fine lenses 31*a* can change the light emitted from the fine light emitters 12 into parallel light.

That is, since the first lens array 30*a* has a plurality of first fine lenses 31*a* respectively matched to the fine light emitters 12, the light emitted from the fine light emitters 12 is changed into parallel light when it passes through the first fine lenses 31*a*. The curvature of first fine lenses 31*a* of the first lens array 30*a* can be determined by applying the autocollimator principle for changing incident light into parallel light.

As described above, the first lens array 30*a* is matched to the light source array 10, so the first lens array 30*a* receives the entire light emitted from the fine light emitters 12. The first fine lenses 31*a* are respectively matched to the fine light emitters 12, so the light emitted from the fine light emitters 12 can be changed into parallel light through the first fine lenses 31*a*.

The second lens array 30*b* is matched to the first lens array 30*a* and has a plurality of second fine lenses 31*b* respectively matched to the first fine lenses 31*a*, and the second fine lenses 31*b* converge the parallel light traveling through the facing first fine lenses 31*a* to the facing shields 21.

That is, since the first lens array 30*a* has a plurality of second fine lenses 31*b* respectively matched to the first fine lenses 31*a*, the parallel light produced through the first fine lenses 31*a* is converged to the shields 21 through the second fine lenses 31*b*. The second fine lenses 31*b* of the second lens array 30*b* may be formed to be convex or concave so that incident light is converged to the shields 21.

The second lens array 30*b* is matched to first lens array 30*a* and the shields 21 and receives the parallel light that has passed through the first fine lenses 31*a*. Further, since the second fine lenses 31*b* respectively matched to the first fine lenses 31*a* are provided, parallel light is converged to the shields 21, whereby optical efficiency is secured.

The lens array may further include a third lens array 30*c* disposed opposite the second lens array 30*b* with the shield array 20 therebetween and sending the light, which has passed through the shield array 20, to the outside. That is, the third lens array 30*c* is a transparent lens and extends the light that has passed through the shields 21 such that the image of light passing through the holes 22 of the shields 21 is clearly projected.

That is, the third lens array 30*c* is matched to the shield array 20, receives the light that has passed through the shields 21, and has a plurality of third fine lenses 31*c* respectively matched to the shields 21, whereby the light that has passed through the shields 21 can be extended and projected to the outside through the third fine lenses 31*c*. To this end, the third fine lenses 31*c* may be formed to be convex such that incident light passing through the facing shields 21 can be extended and projected to the outside.

As described above, the light emitted from the light source array 10 is converged to the shields 21 through the first lens array 30*a* and the second lens array 30*b*, and an image of light according to the difference of brightness is formed as the converged light passes through the shield array 20. The light that has passed through the third lens array 30*c* is extended and forms a clear image, and as such, the image projected to the outside can be more easily recognized.

Figure 5:
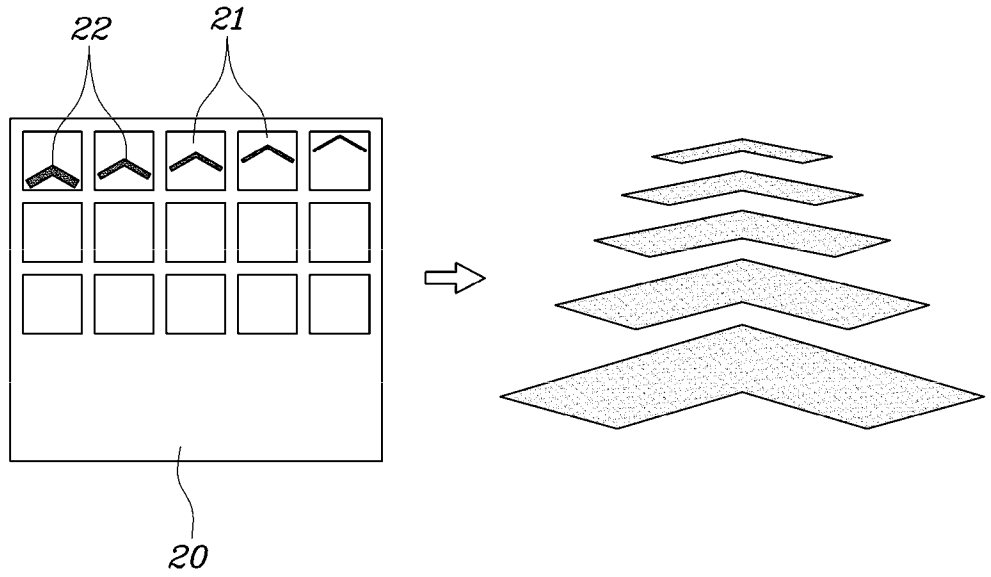
FIGS. 5 to 11 are views showing embodiments of the light device configured to generate a plurality of beam pattern images shown in FIG. 1.

As shown in FIGS. 4 and 5, some or all of the holes 22 of the shield array 20 may have symbol shapes including different characters and numbers.

Since the holes 22 of the shield array 20 have symbol shapes having different characters and numbers, it is possible to form various symbols of characters or numbers in an image that is projected to the outside by controlling turning-on of the fine light emitters 12 in accordance with the messages to be transmitted.

That is, as shown in FIG. 5, when the holes 22 of the shields 21 have a symbol shape sequentially connected, it may be possible to show a route when radiating light by operating fine light emitters 12 corresponding to desired shields 21 of the fine light emitters 12. Further, it is possible to form more easily recognizable images of light by sequentially repeating images according to corresponding symbols by sequentially turning on the fine light emitters 12.

Although not shown, the light device may include or be connected to a controller which may be implemented as a circuit or a processor configured to control the fine light emitters 12. In one example, the controller may be configured to sequentially turn on (and/or turn off) the fine light emitters 12, and/or selectively turn on (and/or turn off) the fine light emitters 12, according to an arrangement of the fine light emitters 12 in the light source array 10, so that light from the light device may have a corresponding pattern.

Figure 6:
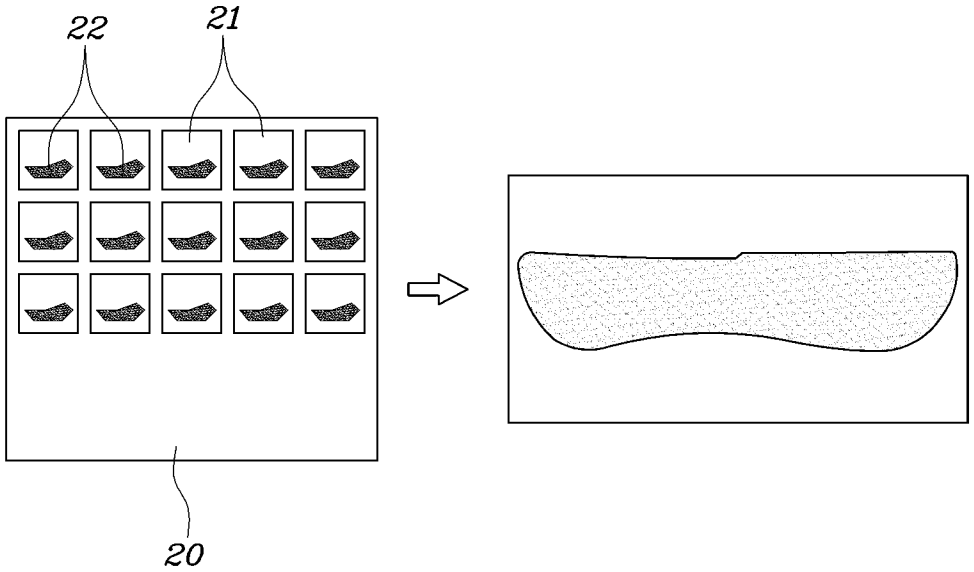

Further, as shown in FIG. 6, it is possible to achieve a low beam forming the shapes of the holes 22 of some shields 21 in a low beam pattern. In this case, the number of the shields 21 having the holes 22 of a low beam pattern may be determined in accordance the amount of light that is required for forming a low beam.

Further, it is possible to vary the color of light by making the fine light emitters 12 radiate light of different colors.

Figure 7:
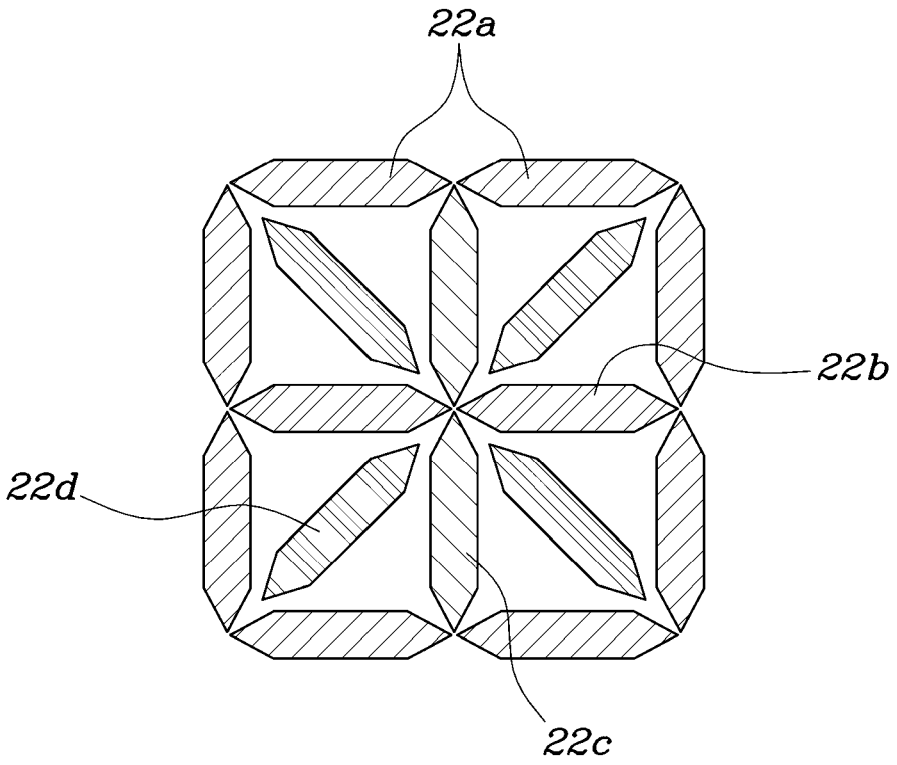

As another embodiment, as shown in FIG. 7, some or all of the holes 22 of the shield array 20 have a rectangular edge 22*a*, a horizontal portion 22*b* horizontally crossing the center of the rectangle, a vertical portion 22*c* vertically crossing the center of the rectangle, and a pair of diagonal portions 22*d* diagonally crossing the center of the rectangle in different directions. The edge 22*a*, the horizontal portion 22*b*, the vertical portion 22*c*, and the diagonal portions 22*d* are each cut half to have the same pattern with two lines, in which any one line of each of them may be open.

That is, the hole 22 of each of the shields 21 has the edges 22*a*, the horizontal portions 22*b*, the vertical portions 22*c*, and the diagonal portions 22*d*, which are each divided into two lines, so the hole 22 can have the shape shown in FIG. 7. In particular, since any one of the two divided lines of each of the edge 22*a*, the horizontal portion 22*b*, the vertical portion 22*c*, and the diagonal portions 22*d* of the hole 22 is open, when some of the fine light emitters 12 are turned on, a plurality of lines is combined, so various shapes of images can be formed.

Figure 8:
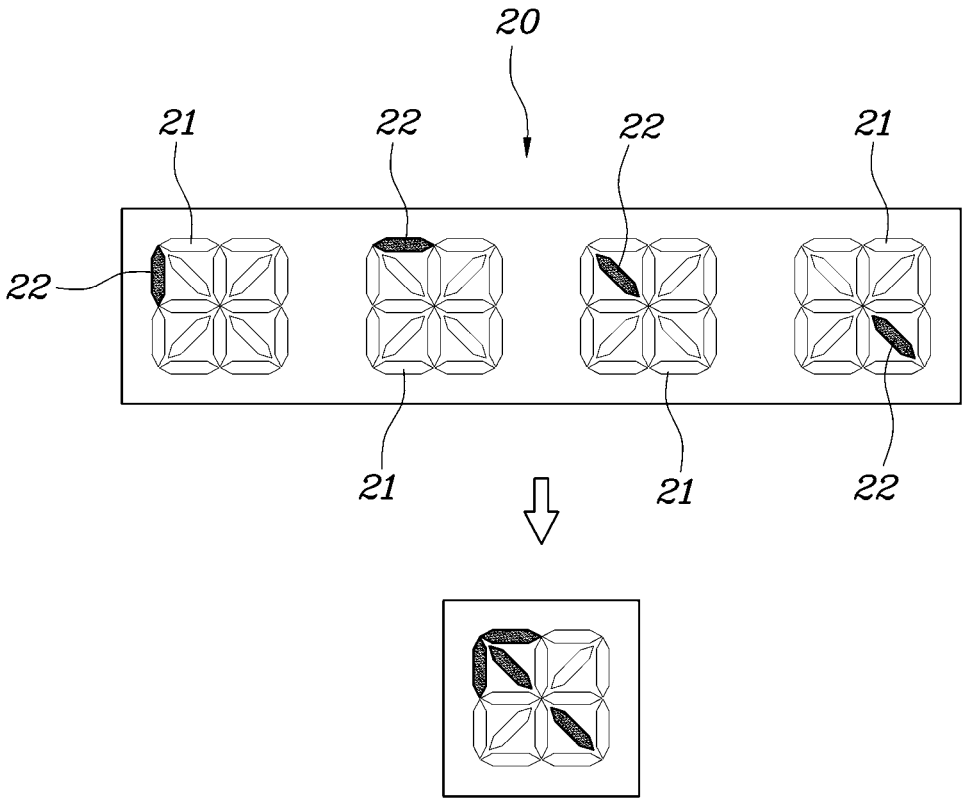

For example, as shown in FIG. 8, in order to form an image '□', the operation of the fine light emitters 12 is controlled so that light is radiated to the shields 21 having lines for forming the image. Accordingly, a light image '□' can be achieved through combination of the lines.

Figure 9:
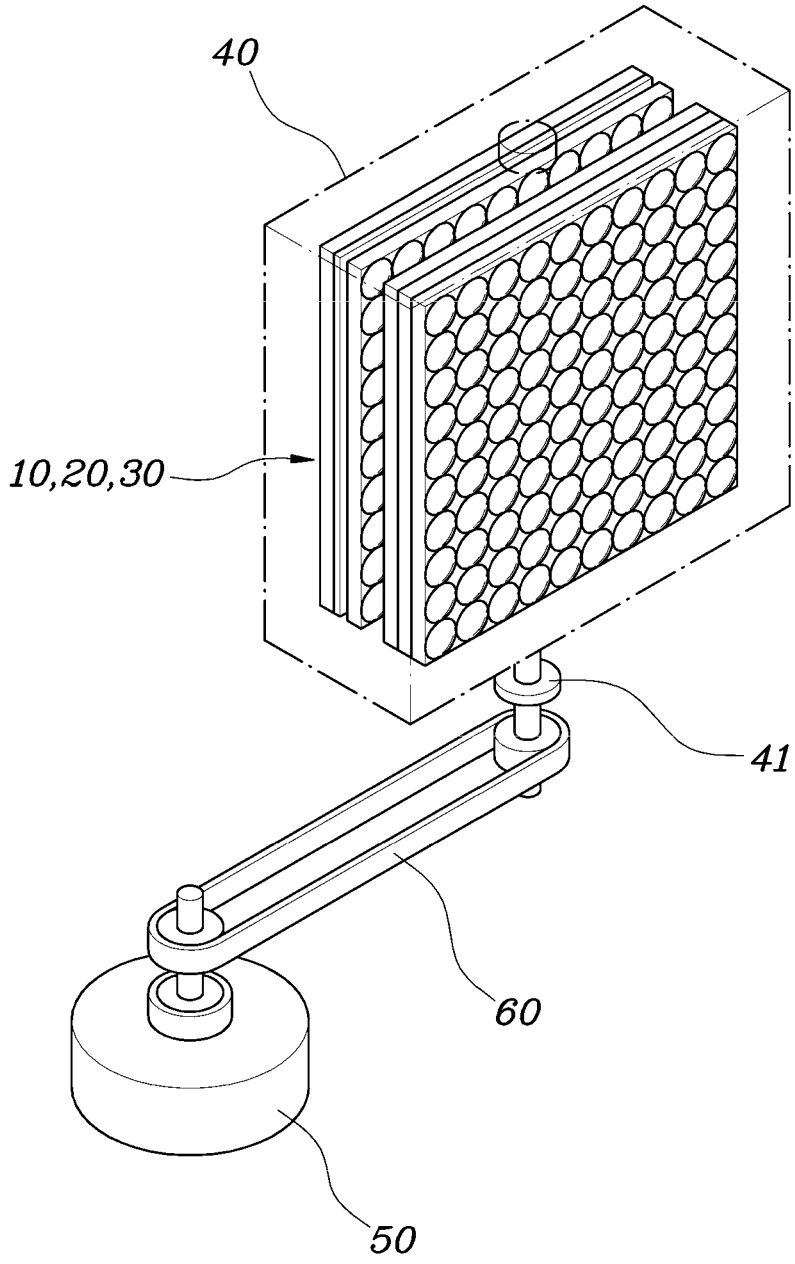
Figure 10:
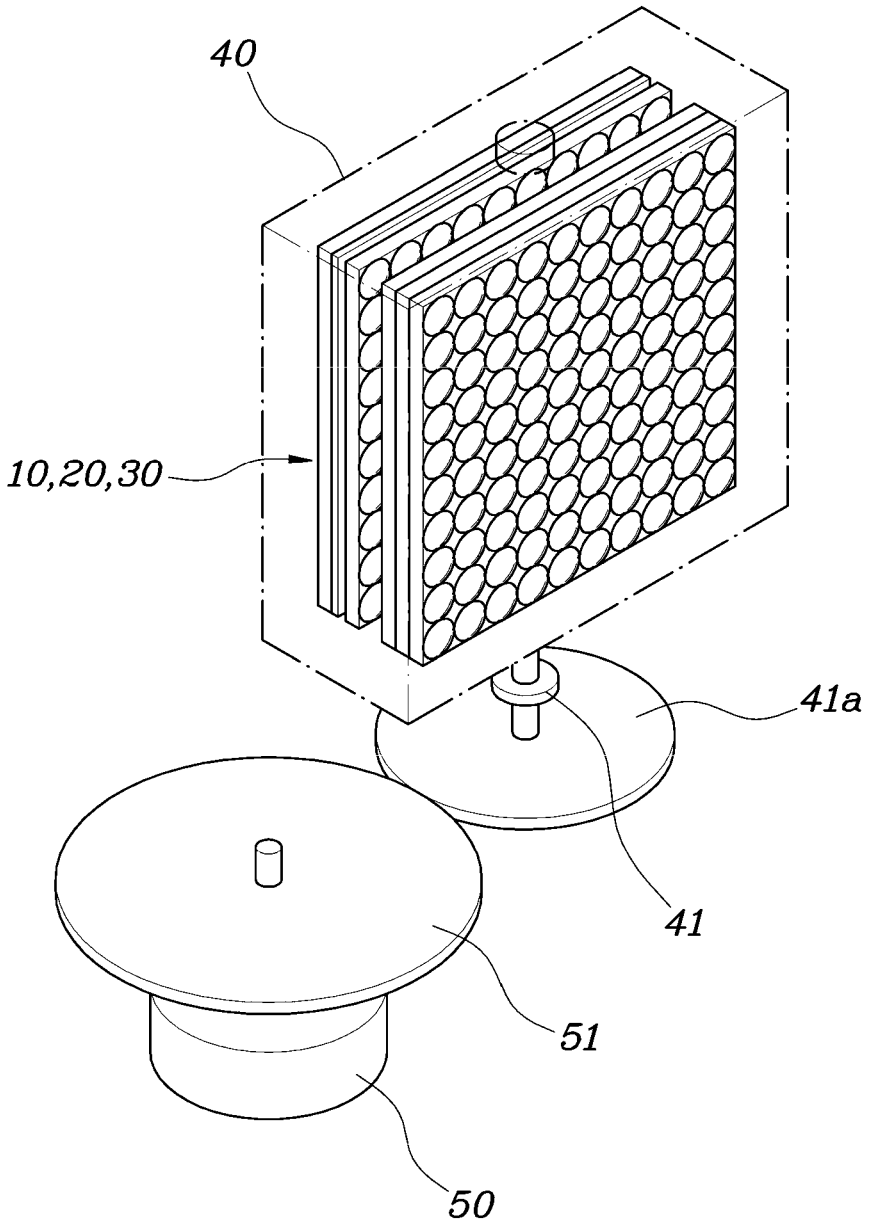

As shown in FIGS. 9 and 10, the light source array 10 and the shield array 20 are installed in a housing 40, thereby forming one assembly, and the housing 40 can be rotated by power from a driving unit 50. Since the light source array 10 and the shield array 20 are installed in the housing 40, as described above, when the housing 40 is rotated, the light source array 10 and the shield array 20 are rotated together. To this end, the driving unit 50 is connected to the housing 40, so when the driving unit 50 is operated, the housing 40 can be rotated.

The rotary connection structure between the housing 40 and the driving unit 50 can be implemented in various ways.

For example, as shown in FIG. 9, the housing 40 has a rotary shaft 41 vertically extending with respect to a surface of the housing, the driving unit 50 includes a motor that provides torque, and the driving unit 50 and the rotary shaft 41 are connected by a chain or a belt 60. Accordingly, when the driving unit 50 is operated, torque is transmitted to the rotary shaft 42 through the chain or the belt 60, so the housing 40 can be rotated.

Further, as shown in FIG. 10, the housing 40 may have a vertical shaft vertically extending and having a driven gear 41*a* thereon, and the driving unit 50 may include motor, and may have a driving gear 51 engaged with the driven gear 41*a*. Accordingly, when the driving unit 50 is operated, the driving gear 51 is rotated and the driven gear 41*a* engaged with the driving gear 51 is rotated with the housing 40, so the housing 40 can be rotated.

Figure 11:
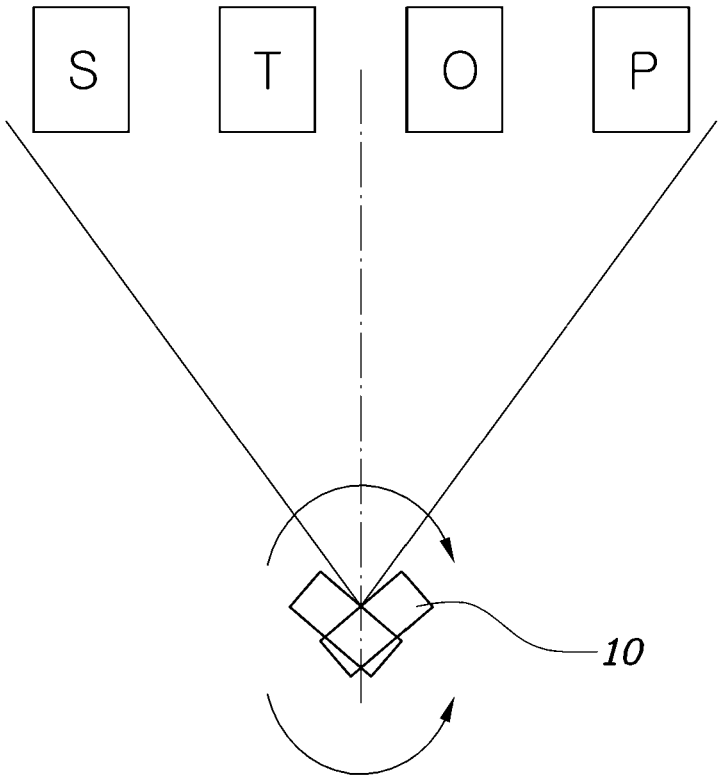

As described above, the driving unit 50 is connected to the vertical shaft of the housing 40 and rotates the vertical shaft, whereby the housing 40 is rotated and a pattern shape of light is projected in the rotational range of the housing 40. That is, as shown in FIG. 11, when the housing 40 is rotated, the light source array 10 and the shield array 20 installed in the housing 40 are also rotated in the same path, so a pattern shape of light is projected in the rotational range of the housing 40. Accordingly, an image of light according to an afterimage effect can be formed by rotating the housing 40 at a high speed, and it is possible to form various images of light in the rotational radius by sequentially, and/or, selectively, turning on some of the fine light emitters 12.

The light device configured to generate a plurality of beam pattern images that has the structure described above can project various pattern shapes of light by radiating light from the fine light emitters 12 through the fine lenses and the shields 21, whereby various patterns are formed in accordance with whether the fine light emitters 12 are turned on. Further, the light source array 10, the shield array 20, and the lens array are each formed in a plate shape, so the size decreases and the structure is simplified.

Although the present disclosure was provided above in relation to specific embodiments shown in the drawings, it is apparent to those skilled in the art that the present disclosure may be changed and modified in various ways without departing from the scope of the present disclosure, which is described in the following claims.

What is claimed is:

1. A light device comprising:

a light source array including a substrate and a plurality of fine light emitters arranged on the substrate and configured to be individually turned on;

a shield array disposed ahead of the light source array, including shields respectively matched to the fine light emitters, wherein each of the shields has a hole through which light passes, and some or all of the holes have different shapes so that a light pattern corresponding to the shapes of the holes is projected when some or all of the fine light emitters are turned on; and a lens array disposed ahead of the light source array and including a plurality of fine lenses respectively matched to each of the fine light emitters, wherein the lens array includes:

a first lens array disposed between the light source array and the shield array and configured to change the light emitted from the fine light emitters into parallel light;

a second lens array disposed between the first lens array and the shield array and configured to converge the light that has passed through the first lens array such that the light passed through the second lens array focuses on the shield array; and a third lens array disposed opposite the second lens array with the shield array, wherein the first lens array is matched to the light source array and has a plurality of first fine lenses respectively matched to the plurality of fine light emitters, and the plurality of first fine lenses change the light emitted from the plurality of fine light emitters into parallel light, wherein the second lens array is matched to the first lens array and has a plurality of second fine lenses respectively matched to the first fine lenses, and the plurality of second fine lenses converge the parallel light traveling through the plurality of first fine lenses to the shields, wherein the light source array, the shield array, and the lens array are each formed in a plate shape, and wherein the shield array, as a single layer disposed between the second lens array and the third lens array, is in direct contact with the second lens array and the third lens array.

2. The light device of claim 1, wherein the third lens array sends light, which has passed through the shield array, to the outside.

3. The light device of claim 2, wherein the third lens array is matched to the shield array and has a plurality of third fine lenses respectively matched to the shields, and the plurality of third fine lenses project light traveling from inside through the shields to the outside.

4. The light device of claim 1, wherein some or all of the holes of the shield array have symbol shapes including different characters and numbers.

5. The light device of claim 1, wherein some or all of the holes of the shield array include edges of a rectangle, a horizontal portion horizontally crossing a center of the rectangle in a first direction, a vertical portion vertically crossing the center of the rectangle in a second direction perpendicular to the first direction, and a pair of diagonal portions diagonally crossing the center of the rectangle in directions different from the first and second directions, and wherein the edges, the horizontal portion, the vertical portion, and the diagonal portions each have bisected halves with respect to a line in the first direction or a line in the second direction.

6. The light device of claim 1, wherein the light source array and the shield array are disposed in a housing, thereby forming one assembly, and the housing is configured to be rotated by power from a driving unit.

7. The light device of claim 6, wherein the housing has a rotary shaft vertically extending with respect to a surface of the housing, and the driving unit is connected to the rotary shaft and is configured to rotate the rotary shaft, whereby a pattern shape of light is projected in a rotational range of the housing in accordance with rotation of the housing.

8. The light device of claim 1, wherein the light device is configured to generate a plurality of beam pattern images.

* * * * *